United States Patent [19]

Haq

[11] Patent Number: 4,515,703

[45] Date of Patent: May 7, 1985

[54] ARTICLE CARRYING ACTIVE MATERIAL

[75] Inventor: Zia Haq, Wirral, England

[73] Assignee: Lever Brothers Company, New York, N.Y.

[21] Appl. No.: 382,500

[22] Filed: May 27, 1982

[30] Foreign Application Priority Data

Jun. 1, 1981 [GB] United Kingdom ..... 8116743
Jan. 11, 1982 [GB] United Kingdom ..... 8200647

[51] Int. Cl.[3] ..... C11D 17/00

[52] U.S. Cl. ..... 252/92; 252/90; 252/91; 15/104.93; 206/620

[58] Field of Search ..... 252/90, 91, 92, 93, 252/134, 174; 15/104.93; 427/212, 208.2, 242; 428/72; 401/196, 205, 35; 101/115, 125; 156/290, 252; 424/15, 28; 128/260, 268, 897, 892; 604/305, 306, 359, 360, 363, 380, 385; 260/820; 206/620

[56] References Cited

U.S. PATENT DOCUMENTS

| | | | |
|---|---|---|---|
| 2,665,528 | 1/1954 | Sternfield et al. | 252/91 |
| 3,175,331 | 3/1965 | Klein | 51/295 |
| 3,196,478 | 7/1965 | Baymiller et al. | 401/196 |
| 3,244,318 | 4/1966 | Berryman et al. | 206/620 |
| 3,334,374 | 8/1967 | Watkins, Jr. | 401/196 |
| 3,382,058 | 5/1968 | Wise | 51/295 |
| 3,402,034 | 9/1968 | Schnabel | 51/295 |
| 3,451,758 | 6/1969 | McClain | 401/201 |
| 3,472,675 | 10/1969 | Gordon | 15/104.93 |
| 4,117,841 | 10/1978 | Perrotta et al. | 604/897 |
| 4,216,104 | 8/1980 | Gergely | 252/91 |
| 4,218,155 | 8/1980 | Weidner | 604/3 |
| 4,240,760 | 12/1980 | Levine | 252/117 |
| 4,259,383 | 3/1981 | Eggensperger et al. | 428/72 |

FOREIGN PATENT DOCUMENTS

| | | |
|---|---|---|
| 2549065 | 5/1977 | Fed. Rep. of Germany . |
| 2625176 | 12/1977 | Fed. Rep. of Germany . |
| 2635256 | 2/1978 | Fed. Rep. of Germany . |
| 2841669 | 4/1979 | Fed. Rep. of Germany . |
| 1304375 | 1/1973 | United Kingdom . |

*Primary Examiner*—Paul Lieberman
*Assistant Examiner*—Hoa Van Le
*Attorney, Agent, or Firm*—Milton L. Honig; James J. Farrell

[57] ABSTRACT

An article for wiping surfaces or for releasing an active material has a "closed sandwich" structure comprising two substrate layers bonded together in such a way as to create a plurality of compartments, at least some of the compartments containing active material, for example, a soap or detergent or bubble bath composition, at least some of the compartments being provided with one or more perforations in one or both walls for release of the active material. Advantageously, different compartments have different numbers of perforations, to allow the active material to be released in a controlled manner over a relatively long period of time. The substrates advantageously comprise paper or nonwoven fabric laminated with thermoplastic film, the two substrate layers being bonded together in a grid pattern by heat-sealing of the thermoplastic films.

14 Claims, 4 Drawing Figures

ARTICLE CARRYING ACTIVE MATERIAL

The present invention relates to an article suitable for wiping a surface, for example, the surface of a household or industrial object, or the human skin, in order to deliver an active material to that surface; or for gradually releasing an active material, such as a bubble bath composition, without surface contact. The article is in the form of a substrate carrying an active material, for example, a detergent composition, a disinfectant, or a skin treatment material.

Various articles consisting of a substrate with a coating of a detergent or other cleansing composition have been described in the literature. For example, German Offenlegungsschrift No. 2 625 176 (Schickedanz) discloses a cleansing cloth consisting of a substrate of nonwoven fabric or wet-strength creped paper to one surface of which a pattern of detergent-active material has been applied. It is also known for such a cloth to have coatings of different detergent-active materials on different areas of the substrate, as disclosed, for example, in U.S. Pat. No. 4,216,104 (Gergely). A problem that has been encountered with products of this type is that the active material is very rapidly released when the product is immersed in water, so that the product is quickly exhausted.

As well as cloths of this "open sandwich" structure there have been proposed "closed sandwich" cloths in which a layer of detergent-active material is sandwiched between two layers of substrate, as for example in German Offenlegungsschrift No. 25 49 065 (Schickedanz), in which the upper layer is of porous material in order to allow release of the detergent-active material when the cloth is immersed in water.

U.S. Pat. No. 2,665,528 (Sternfeld and Block) discloses a disposable abrasive cleaning tissue in which an abrasive material, such as silica, distributed in an adhesive impregnant, is sandwiched between two layers of nonwoven fabric, which are also held together by the adhesive impregnant. Both layers of nonwoven fabric are provided with relatively large perforations in order to expose the abrasive material.

U.S. Pat. No. 4,259,383 (Sterling Drug Inc) discloses a disinfecting cloth in which a dry disinfectant in powder form is held in a number of pockets or voids between two substrate layers which are sealed together between the pockets or voids, for example, by means of adhesive or heat-sealing.

The disinfectant tissue is activated by moistening with water which enters through the water-permeable substrate layers. This double layer substrate construction is not, of course, suitable for containing liquids.

The present invention provides an article in the form of a substrate carrying a releasable active material, the article comprising a first substrate layer and a second substrate layer so bonded together as to create a plurality of compartments therebetween, at least some of said compartments containing active material and at least some of said compartments being provided with one or more perforations in one or each of the substrate walls defining said compartments.

The term "active material" used above is not intended merely to denote detergent-active material but includes any substance that can be delivered by means of an article according to the invention to give a benefit.

Examples of such materials include soap and detergent compositions, bleach, disinfectant, bubble bath compositions, air freshener, skin treatment agents and many more. The active material may be in any suitable form, for example a solid block, a powder, a gel, a liquid, or any combination of these.

According to an especially preferred embodiment of the invention, different compartments of the article are provided with different numbers of perforations, and/or with perforations of different sizes, so that the contents of the different compartments will be released at different rates. Thus controlled release of the active material from the article over a relatively long period may be achieved.

The absolute rate of release will of course depend on the shearing force exerted on the article during wiping. However, the presence of a spread of differently perforated compartments will always ensure a corresponding spread of relative release rates.

This embodiment is also of use for an article containing two or more active materials, when it is desired to release one active material relatively quickly and another more slowly. For example, an article for personal use in the bath or shower may contain a bubble bath composition in quick-release compartments, that is, ones with a relatively large number of perforations and/or with larger-sized perforations, and a soap or detergent composition in slower-release compartments with fewer and/or smaller perforations.

The substrates will generally be of flexible sheet material, for convenience of use, and may be either porous or non-porous depending on the active materials to be incorporated and the intended mode of use. Clearly the substrates and the active material must together be chosen such that the active material can be dispensed efficiently and in a controlled manner in use but on the other hand will not escape prematurely from the article. For example, in one embodiment of the invention, the active material may be in a form, for example, a solid block, a powder or a gel, such that it will be able to leave the article only when mobilised by water or another solvent or dispersing agent. In this case the article will be activated for use by dipping in a liquid, generally water, and the liquid will enter through the perforations and dissolve or disperse out the active material, the solution or dispersion then leaving through the perforations. The substrates may thus advantageously consist wholly of porous or water-permeable material, so that water may enter, and active solution or dispersion leave, through the substrates themselves, as well as through the perforations. In this embodiment, not every compartment need be perforated; those from which the slowest release is desired may depend entirely on transport through the substrates themselves.

Suitable porous flexible sheet materials for use in this embodiment of the invention are fibrous materials such as wet-strength paper and nonwoven fabrics.

The use of porous materials also has the advantage that the outer sides of the article are to some extent absorbent.

In another embodiment of the invention, the active material in the article of the invention is in a relatively mobile form, such as a liquid, and the article includes means for preventing escape of the active material before the point of use.

Where the active material is a liquid of moderate to high viscosity, it is possible for the perforations to be sufficiently small that liquid will not escape through them unless pressure is applied. In this case it is necessary for the substrates themselves to be of material impermeable to liquids, for example, plastics film. It follows that in this embodiment all compartments have at least one perforation, otherwise some liquid would be completely trapped. Accordingly, the means for preventing escape of the active material before the point of use may simply comprise the use of substrates impermeable to the active material in conjunction with sufficiently small perforations.

The substrates in this embodiment may consist wholly of liquid-impermeable material, for example, plastics film. Preferably, however, the outer surfaces of the article are of softer, porous material to give some absorbency and improved handling. Thus the substrates may advantageously comprise sheets of flexible porous material, preferably fibrous material and especially wet-strength paper or nonwoven fabric treated on their inner sides to render them liquid-impermeable. The treatment may be, for example, coating or impregnation with a liquid-impermeable material, for example, a polymer.

Most preferably, however, the substrates in this embodiment are laminates having an inner layer of liquid-impermeable material and an outer layer of porous material. The inner layer preferably comprises a plastics film and the outer layer a wet-strength paper or nonwoven fabric. The inner layer is more preferably a film of thermoplastic material, as discussed in more detail below; polyethylene is especially suitable.

In these embodiments, the perforations will not necessarily extend right through the substrate, but obviously they must penetrate through the liquid-impermeable layer or part.

When the active material is in mobile (liquid) form it may, as discussed above, be loose in the compartments. The feel of the article may, however, be improved if the liquid is carried in foam or sponge material or something similar inside the compartments.

It is also within the scope of the invention for a liquid active material to be protected against premature escape by some kind of encapsulation so that it is released only on the application of pressure at the time of use. The liquid may, for example, be contained in pressure-rupturable microcapsules as described, for example, in British Patent Specification No. 1 304 375 (L'Oréal). Alternatively, the liquid may be held in a highly porous polymer as described in our British patent application No. 81 19739. In these embodiments where the liquid is protected, it is not essential, although it may be advantageous, for the inner surfaces of the substrates to be liquid-impermeable. If they are, every compartment containing liquid must, of course, be provided with at least one perforation.

If desired, the whole article may additionally be impregnated with the same or a different active material to that contained, in the compartments. This is of course especially applicable to articles in which the substrates are at least partially of porous material such as paper or nonwoven fabric.

For ease of manufacture it may be of advantage for the substrates to be at least partially of heat-sealable material, for example a nonwoven fabric consisting of or containing a proportion of fibres of thermoplastic material.

The compartments of the article of the invention may be created by any suitable method. For example, adhesive may be applied in a grid pattern to one substrate layer and the second layer then bonded to the first. If the substrates are of heat-sealable material the grid pattern may be created by heat-sealing.

In this connexion the laminates mentioned above have a further advantage when the inner layer is of a thermoplastic sheet material, in that the inner sides of the substrates can very readily be heat-sealed together both at the edges and to form the compartments.

The application of the active material or materials may be carried out either before or after the bonding together of the two substrate layers, and any suitable method of application may be used. According to one preferred method of manufacture, the active material is first coated onto a first layer of substrate, and a second layer is then bonded onto the first layer, to form a plurality of compartments. This may be carried out as a continuous process, using, for example, roller coating to apply the active material, and hot rollers to bond the two substances by heat-sealing. This method is especially suitable for articles where one active material is to be contained in all compartments, so that the active material can be applied as a continuous coating over the substrate; subsequent heat-sealing may be carried out through the layer of active material. It is also possible, however, for the method to be adapted for articles where different active materials are to be present in different compartments and/or some compartments are to contain no active material at all, for example, by the use of gravure rollers.

Ultrasonic sealing may be used as an alternative to heat-sealing.

Alternatively it is possible first to join the substrates together by adhesive or heat-sealing and subsequently to introduce active materials into selected compartments, for example, by injection or pressure. The injection method also provides perforations in the same operation.

The perforations may be made at any suitable stage in the proceedings. Pre-perforated substrates may if desired be used; this of course requires matching of the perforation pattern to the pattern of bonding between the substrates. Alternatively, the compartments may be perforated after the active material/substrate composite have been made up. In a batch process, perforation may be carried out using a syringe needle.

In a continuous process as mentioned above, the perforations may be made on one or both sides of the article, after the two substrates have been bonded together, by passing the composite article over a roller carrying appropriately spaced pins.

The perforations may be as small as desired, but will generally be at least 0.01 mm in diameter, preferably at least 0.1 mm. Perforations of from 0.2 to 1.2 mm are preferred, especially from 0.5 to 1.0 mm. Of course relatively large perforations are suitable only when the active material is not very mobile or is protected as indicated previously.

The distribution of perforations depends on the size of the compartments as well as on the desired rate of release of the active material. The compartments preferably have areas ranging from 0.5 to 5 $cm^2$, more preferably from 1 to 3 $cm^2$ and especially from 1.5 to 2.5 $cm^2$. The compartments may be of any convenient shape; for ease of manufacture the bonding lines separating them are preferably straight and hence parallelogram shapes, such as square, rectangular, rhomboidal (diamond) and the like, are especially preferred.

The average distribution of perforations is advantageously less than 5/$cm^2$, and preferably lies between 0.5 and 3/cm$^2$. Practicable rates of release of most active materials can be obtained with average perforation levels within this range. Of course the distribution of perforations among the compartments may be either regular or irregular as desired.

In an embodiment of the invention, suitable for cleaning hard surfaces, one or both substrate layers may be provided with a layer of abrasive material on its or their outer surface(s).

Preferably only one of the two substrate layers carries a layer of abrasive material. The article then has one abrasive surface and one surface which may have other characteristics, for example, softness or absorbency. The non-abrasive side is comfortable to the hand and can if desired be used, after cleaning with the abrasive side, for rinsing, drying or polishing.

The abrasive material is advantageously particulate, a particle size of from 10 to 150 μm being preferred. Abrasives of other physical form, for example, fibres, may also be used.

For heavy duty cleaning, a relatively harsh abrasive is advantageous, for example, finely-divided calcite, finely-divided silica, or steel wool fibres. In the case of a particulate abrasive such as calcite, the particle size should be relatively low (preferably below 50 μm) to minimise scratching.

For medium and light duty cleaning, synthetic polymeric abrasive materials are especially useful. These may be in particulate or fibrous form. They provide efficient cleaning without scratching and are especially useful for cleaning non-stick cooking utensils and the like. Abrasives of this type are disclosed, for example, in U.S. Pat. No. 3,382,058 (American Cyanamid Company). Preferred examples are polystyrene, polymethyl methacrylate, and, in particular, polyvinyl chloride. Since these abrasives do not scratch, larger particle sizes can be used, the range of 70 to 150 μm being advantageous.

Polyvinyl chloride particles of two average particle sizes—30 μm and 75 μm—are commercially available from British Drug Houses Ltd and the British Petroleum Company Ltd, and both grades are useful in the wipe of the invention. Desired particle sizes may be obtained by milling and sieving.

The abrasive material is preferably held onto the substrate by means of an adhesive. Suitable adhesives are listed in the aforementioned U.S. Pat. No. 3,382,058 and also in U.S. Pat. No. 3,451,758 (Procter & Gamble) and U.S. Pat. No. 3,175,331 (Union Carbide Company). The adhesive should preferably be elastic, flexible and resistant to deterioration by hot water and concentrated detergent compositions. Thermoplastic heat-curable adhesives are preferred, and especially those which at hot water temperatures are slightly softened so as to increase the flexibility of the article of the invention and thus give it improved "feel" in use; thermoplastic materials having a glass transition temperature below 50° C., preferably below 40° C. and especially below 30° C., are thus preferred. Especially preferred adhesives are vinyl acetate polymers and copolymers, and thermoplastic acrylic polymers and copolymers. Polyvinyl acetate, polybutyl methacrylate, and styrene/butyl methacrylate coplymers all give good results.

The adhesive and abrasive may be applied to the substrate by any suitable method. Roller coating and screen printing both give good results; when the adhesive and abrasive are to be applied by a printing method, a thickener, for example, polyvinyl alcohol, carboxymethyl cellulose, xanthan gum or gum arabic, is advantageously added. Alternatively a solution or dispersion of the polymer adhesive containing dispersed abrasive particles may be sprayed onto the substrate and subsequently heat-cured.

If desired, the abrasive particles may be formed in situ on the substrate by spraying molten or dissolved polymer onto the substrate.

The adhesive and abrasive are advantageously applied to the substrate before the composite article is made; the article can then be prepared using one sheet of abrasive-coated substrate and one sheet of uncoated substrate. This may be done continuously. Alternatively the finished article may be treated, preferably on one side only, with adhesive and abrasive.

Advantageously the perforations which allow release of the active material from within the compartments are made after the application of the adhesive and abrasive, to avoid the danger of blockage.

The invention will now be described in further detail, by way of example only, with reference to the accompanying drawings, in which.

Figure 1:
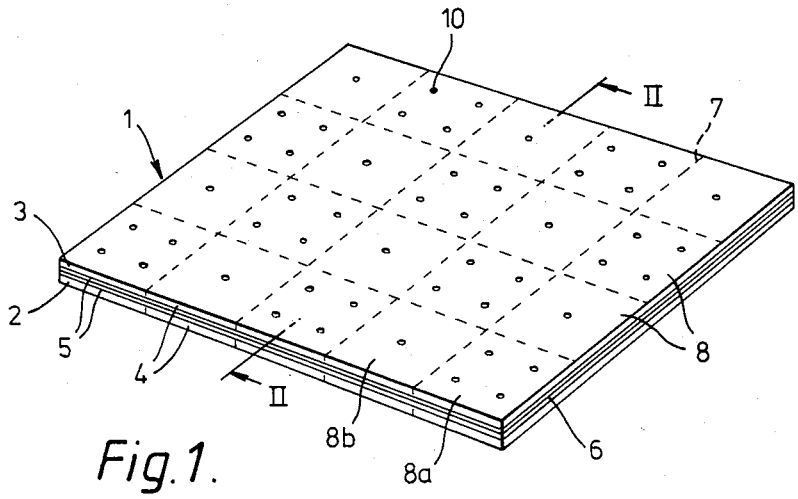
FIG. 1 is an isometric view of a first article according to the invention.
Figure 2:
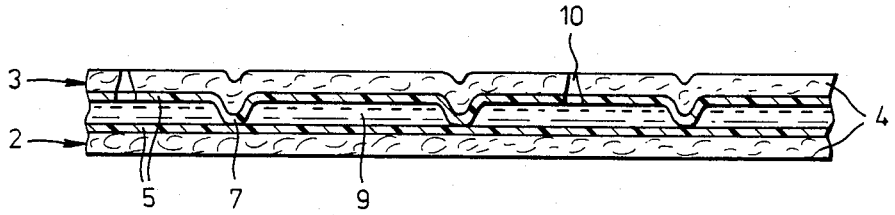
FIG. 2 is a fragmentary section along the line II—II of FIG. 1.

Referring now to FIGS. 1 and 2 of the drawings, an article 1 consists of a lower substrate 2 and an upper substrate 3, each consisting of a layer 4 of nonwoven fabric or wet-strength paper and, laminated thereto on one side only, a thin film 5 of polyethylene. The substrates 2 and 3 are so positioned with respect to one another that the polyethylene-coated sides 5 are in contact. The polyethylene layers 5 of the two substrates are heat-sealed together along the edge regions 6 and also in a grid pattern 7, indicated in FIG. 1 by dotted lines, to form a plurality of compartments 8, each approximately 1.3 cm×1.3 cm, each containing a viscous liquid active material 9, for example, a concentrated bubble bath composition. Perforations 10 are provided in the upper layer 3, the numbers of perforations in each compartment varying, so that, for example, the compartment 8*a* will release its contents considerably more rapidly than compartment 8*b* when the article 1 is immersed in water. For clarity the size of the perforations 10 and the thickness of the article 1 in comparison to its surface area have been greatly exaggerated; the perforations are in fact sufficiently small that the liquid 9 will not escape through them unless the article 1 is immersed in water and/or pressure is applied.

In use the article is wetted and applied to the body during a bath or shower, the active material is released by squeezing in the hand or pressing against the body. Alternatively or additionally, for bath use, the article may be immersed in the bathwater, for example, as the bath is filled, and will gradually release its contents.

Figure 3:
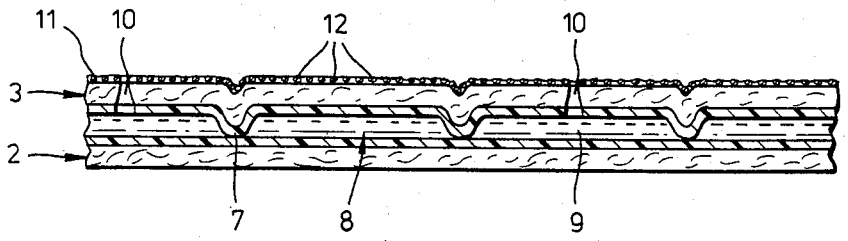
FIG. 3 is a section, corresponding to FIG. 2, of a second article according to the invention.

FIG. 3 shows an alternative embodiment intended for hard surface cleaning; in this case the viscous liquid active material 9 is suitably a concentrated detergent composition. On the outer surface of the upper substrate 3 is provided a layer of adhesive 11 in which particles of abrasive 12 are embedded. The perforations 10 are provided only in the upper substrate 3. In use the article is dipped into water and its abrasive side 3 is used to clean a soiled hard surface; active material 9 is released during this operation by squeezing. The non-abrasive side 2 may be used for a subsequent rinsing, drying or polishing operation.

Figure 4:
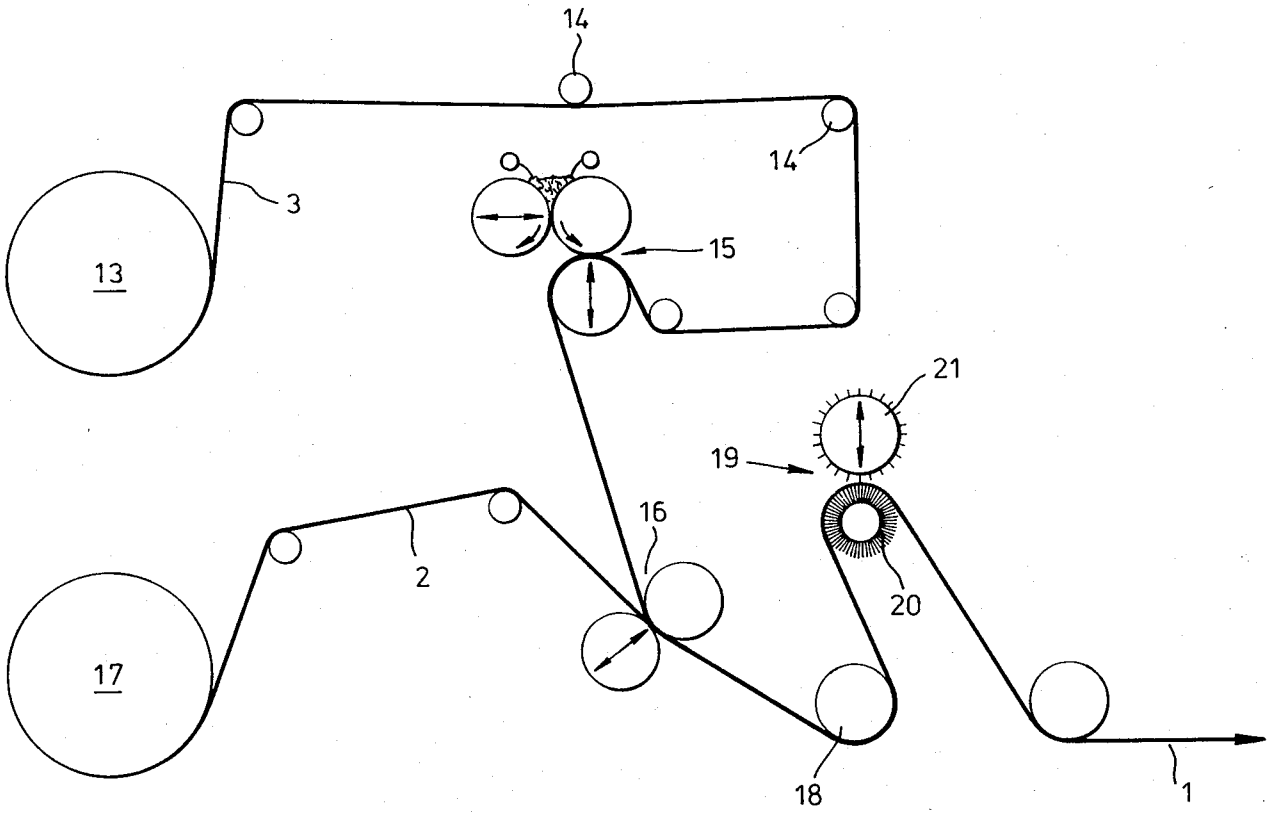
FIG. 4 is a schematic representation of a continuous process for the manufacture of the article of FIGS. 1 and 2.

FIG. 4 shows a continuous method for the production of the article described above with reference to FIGS. 1 and 2.

The upper substrate layer 3 is unwound from a supply roll 13, passes around various tensioning rollers 14 and is coated with the active material 9 by a three-roll reverse coater 15. It then passes to a heat-sealing unit 16 where it is bonded both at the edges and in a grid pattern to the lower substrate layer 2 which is unwound from a supply roll 17. The composite material 1 then passes around a cooling roller 18 to a perforating device 19 in which it is tensioned over a brush roller 20 and perforated by means of a pin-carrying roller 21. The finished composite material is then ready to be cut to size to form individual articles.

The invention is further illustrated by the following non-limiting Examples.

EXAMPLE 1

Individual sachets, each 2.5 cm×2.5 cm, were made by heat-sealing together two layers of polyethylene-laminated creped paper (Gessner Duftex (Trade Mark) M3, ex Gessner & Co GmbH, Bruckmühl, W. Germany), extrusion-coated with Alkathene (Trade Mark) 7 ex ICI: these sachets were intended to simulate the compartments of an article according to the invention. Each sachet contained a small, precisely weighed amount (in each case approximately 0.8 g) of nonionic detergent-active agent (nonyl phenol 8 EO ethoxylate). Using a syringe needle having a diameter of 0.8 mm, numbers of perforations varying from 2 to 20 were made in the various sachets.

Each sachet was then immersed in 1 litre of water at 18° C. and stirred for several hours. Samples of water were taken at intervals and the UV absorbance at 276 nm was measured in order to determine the concentration of nonionic detergent-active agent released from the sachet, and hence the percentage loss of detergent-active agent from the sachet. The results are shown in the following Table.

It may be seen that a tenfold increase in the number of holes increases the release rate by a factor of approximately 15; after 30 minutes, 3% of the active material had been released from the sachet with 2 perforations, whereas just over 45% had been released from the sachet with 20 perforations.

TABLE

| Time (mins) | % of active released Number of Perforations 2 | 6 | 8 | 12 | 20 |
|---|---|---|---|---|---|
| 2 | 0 | — | 10 | — | 13 |
| 5 | 0 | — | 21 | 13 | — |
| 6 | 0 | 5 | — | — | — |
| 10 | 0 | 10 | 28 | 24 | 32 |
| 15 | 0 | 17 | — | — | — |
| 20 | 0 | 20 | 34 | 36 | 40 |
| 25 | 1 | — | — | — | — |
| 30 | 3 | 25 | 36 | 39 | 47 |
| 40 | 10 | 29 | 39 | 44 | 55 |
| 50 | 13 | — | — | — | — |

EXAMPLE 2

An article of the construction described above with reference to FIGS. 1 and 2 of the accompanying drawings was prepared for use as a bath or shower product. The substrate layers each consisted of a nonwoven fabric (Storalene (Trade Mark) 610:60 ex Stora-Copparberg, consisting of 40% cotton linters, 55% viscose and 5% polyamide and having a base weight of 60 g/m$^2$) extrusion-coated with a 20–30 μm layer of polyethylene (Alkathene (Trade Mark) 7 ex ICI). The size of the article was 30×30 cm, and the compartments were each 1.3×1.3 cm. The active material, which was present in every compartment, was a bath foam composition consisting of coconut alcohol 3 EO ether sulphate (Empicol (Trade Mark) ESB 70 ex Albright & Wilson) and coconut monoethanolamide (Empilan (Trade Mark) CME ex Albright & Wilson) in a weight ratio of 20:1, at a total concentration of 15–25% by weight. The loading of the active material was 6 g, equivalent to 66 g/m$^2$ of substrate.

The product was pinholed such that 50% of the compartments had 10 perforations/cm$^2$ and the remaining 50% had 2.4 perforations/cm$^2$.

The product was first tested in a bath with running water, and was found to provide approximately the same volume of lather as a 25 ml dose of a commercially available liquid bath foam product (Norsca (Trade Mark) ex Elida Gibbs). The same product was then used in a hand/arm wash by a test panel and judged for ease of lather formation and ability to sustain this on repeated rinsing. The product yielded most of its active material in a controlled manner over a period of 20 to 30 minutes.

EXAMPLES 3–6

Three articles of the construction described above with reference to FIG. 2 of the accompanying drawings were prepared for use as medium duty household cleaners. The substrates were as specified in Example 2, and the active material, which was present in all compartments, was 12 g of a paste (50% solids content by weight) of alkylbenzene sulphonate and sodium tripolyphosphate (1:1).

To each article there was applied to one face only a particulate abrasive in a thermoplastic adhesive. The adhesives and abrasive were applied together by a screen printing technique. The three compositions used were as follows:

| Example | Abrasive Material | Particle size | Parts by weight | Adhesive (1 part by weight) |
|---|---|---|---|---|
| 3 | calcite: Durcal (Trade Mark) 40 | 40 μm | 2 | High-molecular weight polystyrene in toluene (10% solution) |
| 4 | calcite: Durcal (Trade Mark) 40 | 40 μm | 3 | Vinyl acetate latex (ex Vinyl Products Ltd) |
| 5 | polyvinyl chloride powder (ex British Drug Houses Ltd) | 75 μm | 3 | Butyl methacrylate (ex Vinyl Products Ltd) |
| 6* | polystyrene powder | less than 150 μm | 1 | Styrene-acrylic ester-acrylic acid terpolymer (ex Vinyl |

-continued

| Example | Abrasive Material | Abrasive Particle size | Abrasive Parts by weight | Adhesive (1 part by weight) |
|---|---|---|---|---|
| | | | | Products Ltd) |

*with 1 part 2% xanthan gum in water, as thickener.

The articles of Examples 3 and 4 were highly effective for cleaning heavily soiled surfaces, for example the top of a cooker. The article of Example 5, with a polymeric adhesive, could be used on nonstick cookware without scratching.

None of these articles felt harsh to the touch, and on wetting with hand-hot tap water (about 50° C.) were flexible enough to be comfortably folded or crumpled in the hand for use.

I claim:

1. An article in the form of a substrate carrying a releasable active material, said article comprising first and second substrates each comprising an outer layer of a paper or nonwoven fabric completely surrounding and having laminated thereto or coated thereon an inner layer of active liquid-impermeable thermoplastic material, said inner layers being so bonded together as to create a plurality of compartments therebetween, at least some of said compartments containing said releasable active material and each of said compartments carrying active material being provided with one or more perforations having diameters within the range of from 0.2 to 1.2 mm in one or each of the substrate walls defining said compartments, the distribution of perforations being within the range of from 0.5 to $3/cm_2$, said perforations providing the means for release of said releasable active material.

2. The article of claim 1, wherein different compartments are provided with different numbers of perforations.

3. The article of claim 1, wherein different compartments contain different active materials.

4. The article of claim 1, wherein it contains a liquid active material that is prevented from escaping unless either pressure is applied or is dipped in a liquid which dissolves or disperses out the active material.

5. The article of claim 1, wherein it includes as active material a detergent composition.

6. The article of claim 1, wherein the first and second substrate layers are of flexible sheet material.

7. The article of claim 1, wherein the compartments have area within the range of from 0.5 to $5/cm^2$.

8. The article of claim 1, wherein the compartments are of parallelogram shapes.

9. The article of claim 1, wherein one or each substrate layer carries a layer of abrasive material on its outer surface.

10. The article of claim 1, wherein said substrates are bonded together by heat-sealing or ultrasonic sealing.

11. The article of claim 9, wherein the abrasive comprises a particulate material having a particle size within the range of from 10 to 150 $\mu$m.

12. The article of claim 9, wherein the abrasive material is a synthetic polymeric material.

13. The article of claim 9, wherein the abrasive material is selected from the group consisting of polystyrene, polyvinyl chloride, and polymethyl methacrylate.

14. The article of claim 9, wherein the abrasive material is held on the substrate layer(s) by a thermoplastic adhesive.

* * * * *